US009415292B2

(12) United States Patent
Reino et al.

(10) Patent No.: US 9,415,292 B2
(45) Date of Patent: Aug. 16, 2016

(54) GOLF CUP ACCESSORY

(75) Inventors: Donald J. Reino, Costa Mesa, CA (US); Michael Austin Miller, Bellflower, CA (US)

(73) Assignee: DUNLOP SPORTS CO. LTD., Kobe (JP)

( * ) Notice: Subject to any disclaimer, the term of this patent is extended or adjusted under 35 U.S.C. 154(b) by 393 days.

(21) Appl. No.: 13/485,212

(22) Filed: May 31, 2012

(65) Prior Publication Data

US 2013/0324273 A1 Dec. 5, 2013

(51) Int. Cl.
*A63B 69/36* (2006.01)
*A63B 57/00* (2015.01)

(52) U.S. Cl.
CPC ..... *A63B 69/3676* (2013.01); *A63B 57/00* (2013.01); *A63B 57/357* (2015.10); *A63B 57/40* (2015.10); *A63B 2225/09* (2013.01)

(58) Field of Classification Search
CPC ..... A63B 57/00; A63B 57/0056; A63B 69/3676; A63B 71/02; A63B 71/04; A63B 2063/00; A63B 2063/001; A63B 2063/002; A63B 63/00; A63B 63/007; A63B 63/08; A63B 67/02
USPC ..... 473/173–189; D21/790; 273/127 R
See application file for complete search history.

(56) References Cited

U.S. PATENT DOCUMENTS 1,287,903 A * 12/1918 Daily ..... 473/180
2,121,270 A * 6/1938 Streich ..... 473/185
2,836,422 A * 5/1958 Borah ..... 473/187
2,933,318 A * 4/1960 Boynton ..... 473/186
3,647,216 A * 3/1972 Breslow ..... 273/123 R
3,711,100 A * 1/1973 Crowder ..... 273/127 R
3,752,482 A * 8/1973 Cassel ..... 473/169
3,797,833 A * 3/1974 Rokusek ..... 473/180
3,920,245 A * 11/1975 Gothreaux et al. ..... 473/470
D242,370 S * 11/1976 Arndt et al. ..... D21/790
4,149,719 A 4/1979 Wakefield
4,647,047 A * 3/1987 Little ..... 473/187
4,660,834 A * 4/1987 Carrigan ..... 473/165
4,717,156 A * 1/1988 Wright ..... 273/401
4,878,671 A * 11/1989 Gubany ..... 473/195
4,906,006 A 3/1990 Sigunick
4,925,191 A * 5/1990 Ogilvie ..... 473/189
4,949,970 A * 8/1990 Culley ..... A63B 67/02 473/160
4,957,290 A * 9/1990 Major et al. ..... 473/410
5,131,658 A * 7/1992 Grenon ..... 473/185
5,257,808 A * 11/1993 Mueller et al. ..... 473/174
5,275,405 A * 1/1994 Ridge ..... 473/180
5,415,397 A 5/1995 Van Holt, Jr.
5,478,071 A * 12/1995 Barrs et al. ..... 473/176
5,487,545 A * 1/1996 Schindler ..... 473/187
5,524,891 A 6/1996 Owen, Jr. et al.
5,776,004 A 7/1998 Wilson
5,997,406 A * 12/1999 Selton ..... 473/180
6,709,342 B1 3/2004 Brezic
7,347,789 B2 * 3/2008 Patterson ..... 473/180
7,611,418 B2 * 11/2009 Patterson ..... 473/180
D624,982 S * 10/2010 Perusa ..... D21/789

(Continued)

*Primary Examiner* — Mark Graham
(74) *Attorney, Agent, or Firm* — Oliff PLC

(57) ABSTRACT

An accessory for association with a standard golf up includes an adapter, a trapping portion and a rise. The adapter is configured to fit within the standard golf cup. The trapping portion is coupled to the adapter, has a recess and delimits a generally planar approach area that is greater in size than an approach area of a standard golf cup. The rise is coupled to the trapping portion.

33 Claims, 14 Drawing Sheets

(56) References Cited

U.S. PATENT DOCUMENTS 7,914,387 B1 * 3/2011 Gugliotti ..... 473/174
8,177,233 B2 * 5/2012 Grayson ..... 273/118 R
2004/0235580 A1 * 11/2004 Barlow et al. ..... 473/175
2005/0115849 A1 * 6/2005 Nally ..... 206/315.1
2007/0099716 A1 * 5/2007 Du Plessis ..... 473/179

* cited by examiner

GOLF CUP ACCESSORY

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

The game of golf has gained great popularity attracting more new players than ever before. However, the skills necessary to play the game are difficult to master, particularly when it comes to putting. A number of practice putting devices exist that reduce the diameter of a standard golf cup.

SUMMARY

The relatively small diameter of the standard golf cup makes putting challenging and frustrating to even the most skilled golfers. Due to their reduced diameter, existing practice putting devices make putting into these devices even more challenging than putting into a standard golf cup. To new players, such frustration may prove difficult to overcome and may ultimately turn many new players away from the game.

Thus, a need exists for a golf cup accessory that effectively increases the approach area of a standard golf cup, i.e., the opening area as described below, thereby relieving some of the frustration that new golfers face as they learn to putt. The golf cup accessory according to various embodiments of the present invention effectively increases the approach area of a standard golf cup. Further, the golf cup accessory preferably may fit any standard golf cup, be easy to install, be durable and be customizable to provide varying degrees of golf cup area augmentation, depending on the skill level of a given golfer.

According to an embodiment of the invention, an accessory for association with a standard golf cup includes an adapter, a trapping portion and a rise. The adapter is configured to fit within the standard golf cup. The trapping portion is coupled to the adapter, has a recess and delimits a generally planar approach area that is greater in size than an approach area of the standard golf cup. The rise is coupled to the trapping portion.

According to another embodiment of the invention, an accessory for association with a standard golf cup includes a trapping portion and a rise. The trapping portion has a recess and delimits a generally planar approach area that is greater in size than an approach area of the standard golf cup. The rise is coupled to the trapping portion. When the accessory is in an operating position, the trapping portion includes a downwardly extending throughbore, extending from the bottom surface of the trapping portion entirely through the accessory, that aligns with an opening formed by the standard golf cup.

According to yet another embodiment of the invention, a practice golf cup includes a rise portion and a trapping portion coupled to the rise portion. The trapping portion has a recess, a rim, and a surface portion that includes a golf ball trajectory modifier selected from the group consisting of an ultra-smooth surface, a material of high rolling resistance, and at least one baffle.

These and other features and advantages of the various embodiments of the invention in their various aspects as provided by one or more of the various examples described in detail below, will become apparent after consideration of the ensuing description, the accompanying drawings, and the appended claims. The accompanying drawings are for illustrative purposes only, are not drawn to scale, and are not intended to limit the scope of the present invention.

BRIEF DESCRIPTION OF THE DRAWINGS

Exemplary embodiments of the present invention will now be described with reference to the following drawings, in which.

DETAILED DESCRIPTION OF EMBODIMENTS

Figure 1:
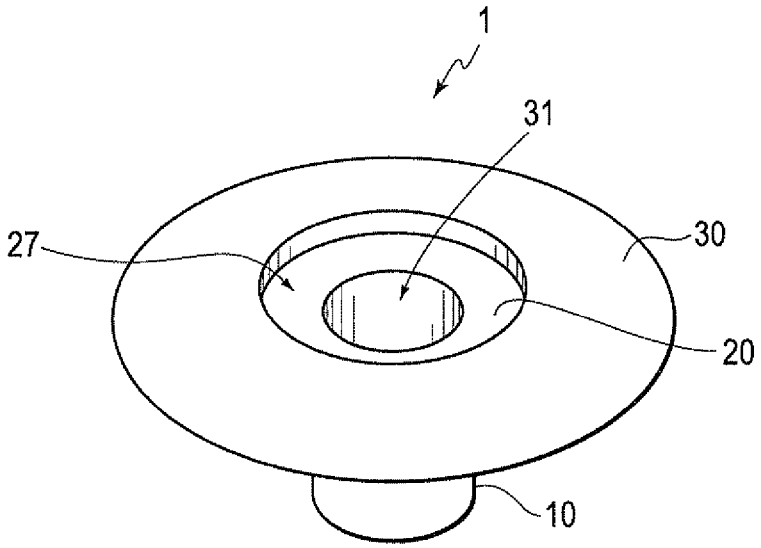
FIG. 1 is a perspective view of a golf cup accessory according to a first embodiment of the present invention.
Figure 2:
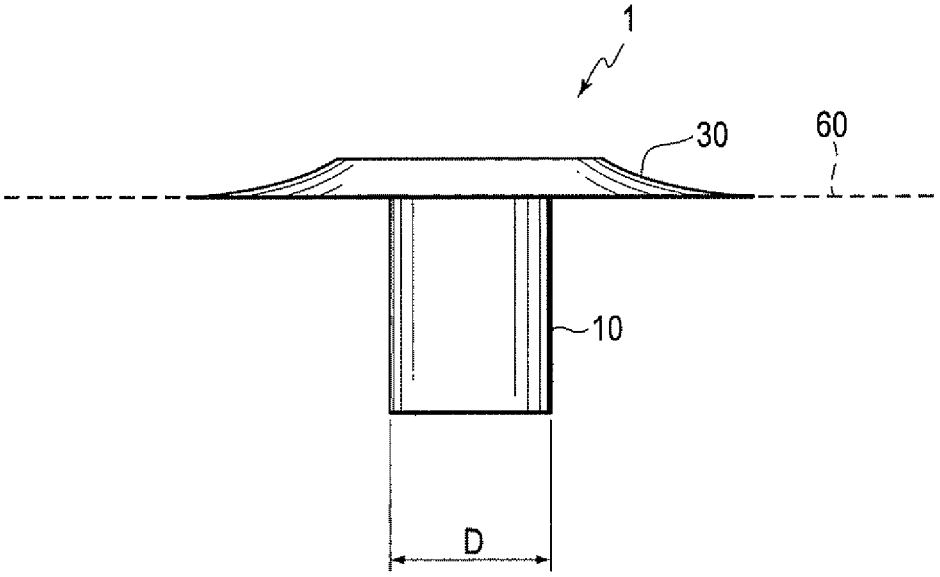
FIG. 2 is a side view of the golf cup accessory of FIG. 1.

Referring to FIGS. 1-6E, an exemplary embodiment of a golf cup accessory having a number of exemplary alternative configurations is depicted. The golf cup accessory 1 includes an adapter 10, a trapping portion 20 and a rise 30. The adapter 10 is configured to fit within a standard golf cup. As used herein, a standard golf cup is a golf cup having an inside diameter of 4.25 inches (within a reasonable margin of error) and a depth of at least 4 inches, and therefore complies with USGA (United States Golf Association) and other international golf regulations.

In one embodiment, the adapter 10 may have a shape that is substantially complementary to that of a standard golf cup. Accordingly, the adapter 10 may have a substantially cylindrical shape with an outer diameter D that ranges between about 3.75 inches and about 4.25 inches, more preferably ranging between about 4.0 inches and about 4.25 inches, and even more preferably ranging between about 4.20 inches and about 4.25 inches. Preferably, a snug fit is provided between the adapter 10 and the standard golf cup.

However, the outer diameter D of the adapter 10 need not be limited to the above-disclosed ranges and may, for example, have any outer diameter D that is equal to or less than 4.25 inches, as long as the adapter 10 fits within a standard golf cup. Further, the adapter 10 is not limited to a substantially cylindrical shape. For instance, the adapter 10 may have any substantially polygonal shape, or any other shape, so long as the adapter 10, irrespective of its outer shape, is able to fit within a standard golf cup. Alternatively, or in addition, the adapter 10 is configured to fit within a conventional flagstick receiver (not shown) of a standard golf cup.

At least a portion of the adapter 10 may be hollow. In one embodiment, the entire adapter 10 may be hollow, defining a downwardly extending throughbore 31 having a substantially cylindrical inner space with an inner diameter D' that is smaller than the outer diameter D of the adapter 10 (see e.g. FIG. 4). The space within the inner diameter D' and the outer diameter D defines a thickness of the adapter 10. The thickness of the adapter 10 may vary according to the material that is used for its construction, the desired weight, or the desired useable life of the golf cup accessory 1.

Figure 4:
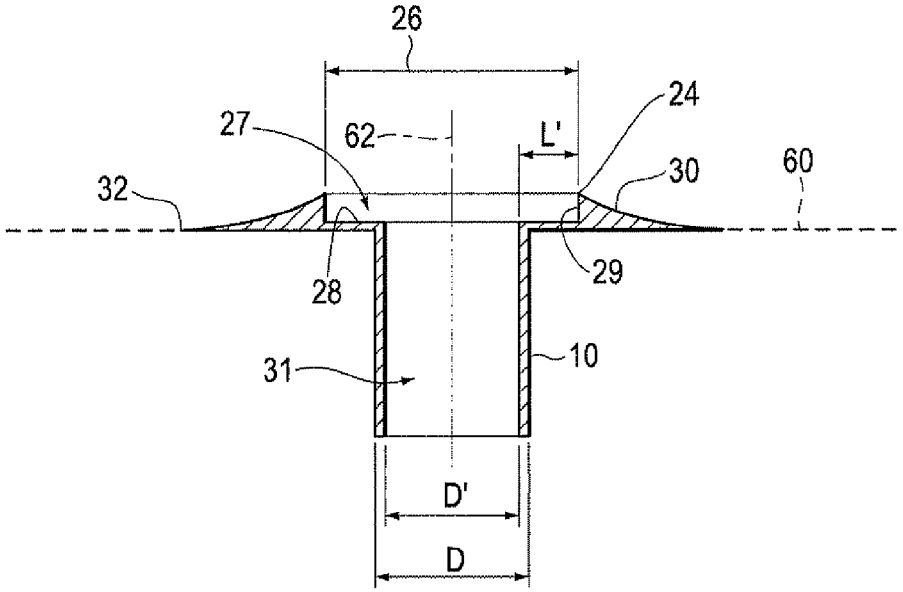
FIG. 4 is a cross-sectional view of the golf cup accessory of FIG. 1 along line 4-4 of FIG. 3.
Figure 5A:
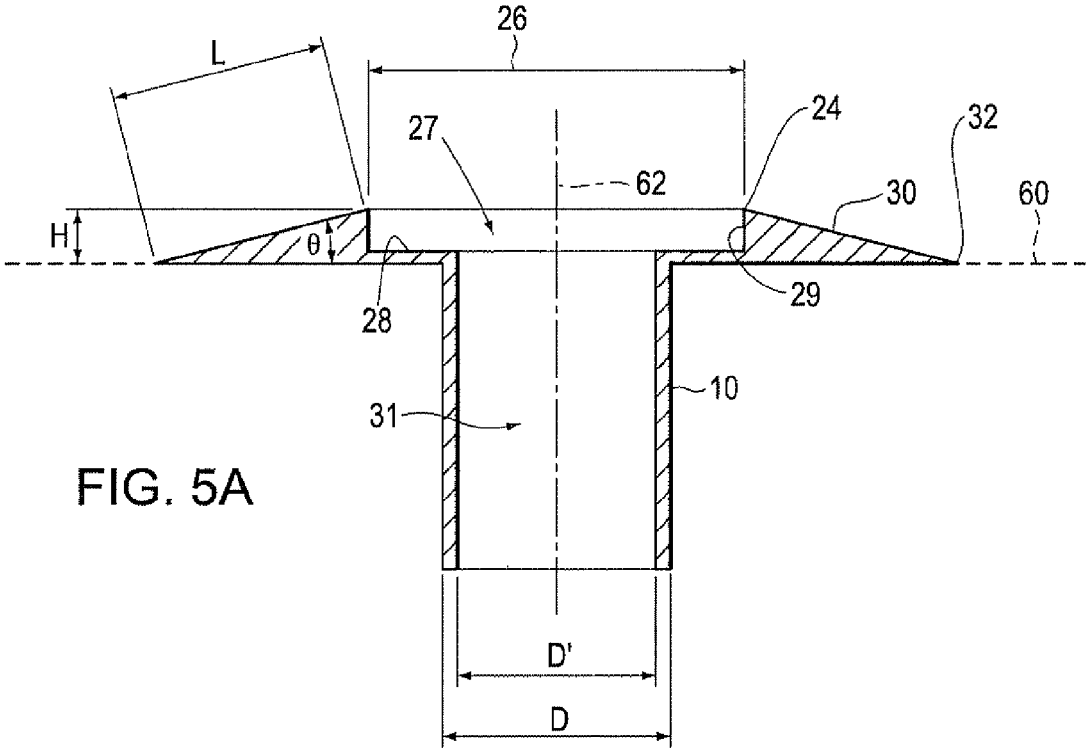
FIG. 5A is a cross-sectional view of a first alternative configuration of the golf cup accessory of the first embodiment.
Figure 5B:
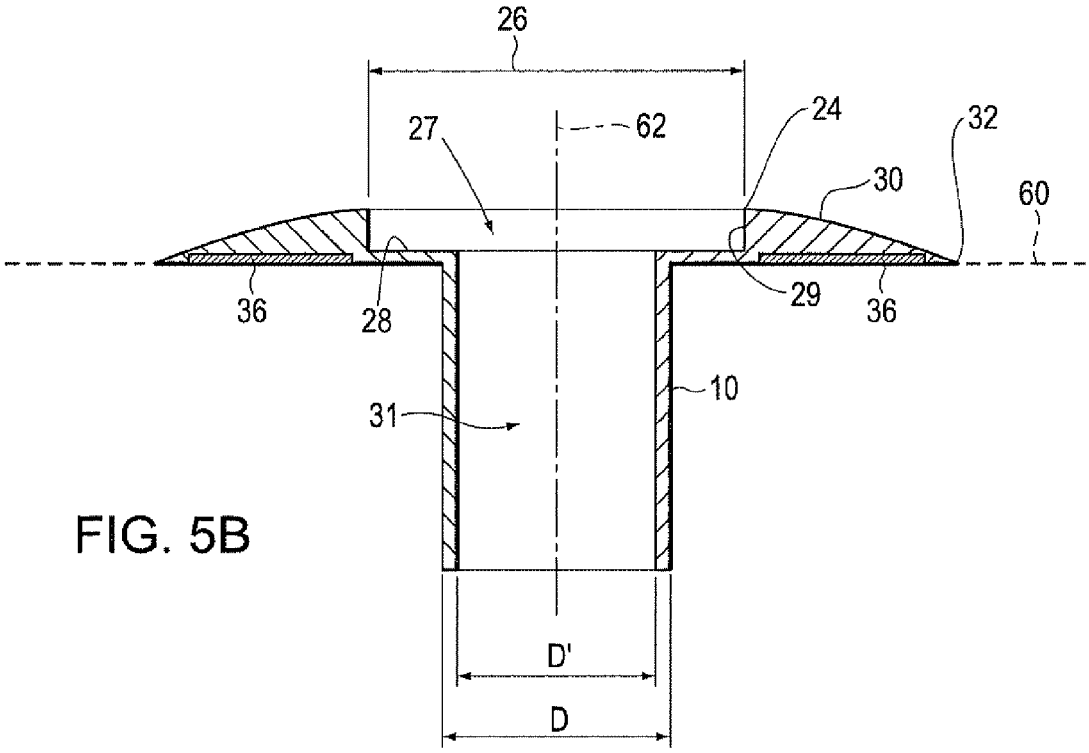
FIG. 5B is a cross-sectional view of a second alternative configuration of the golf cup accessory of the first embodiment.
Figure 5C:
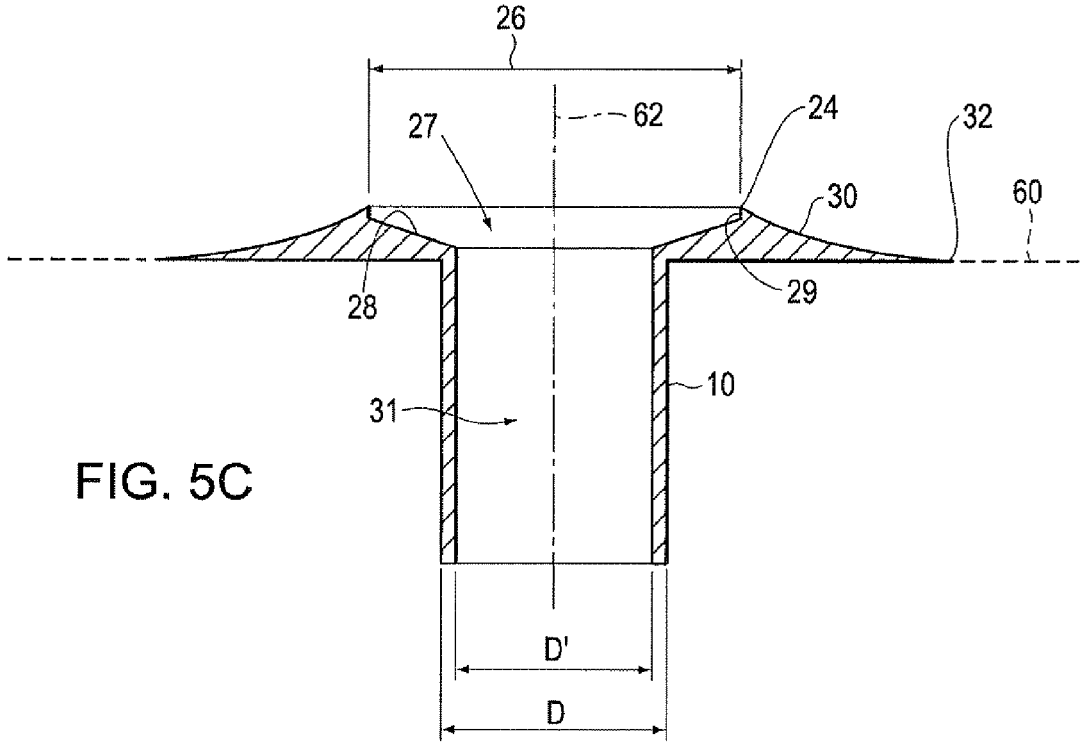
FIG. 5C is a cross-sectional view of a third alternative configuration of the golf cup accessory of the first embodiment.
Figure 5D:
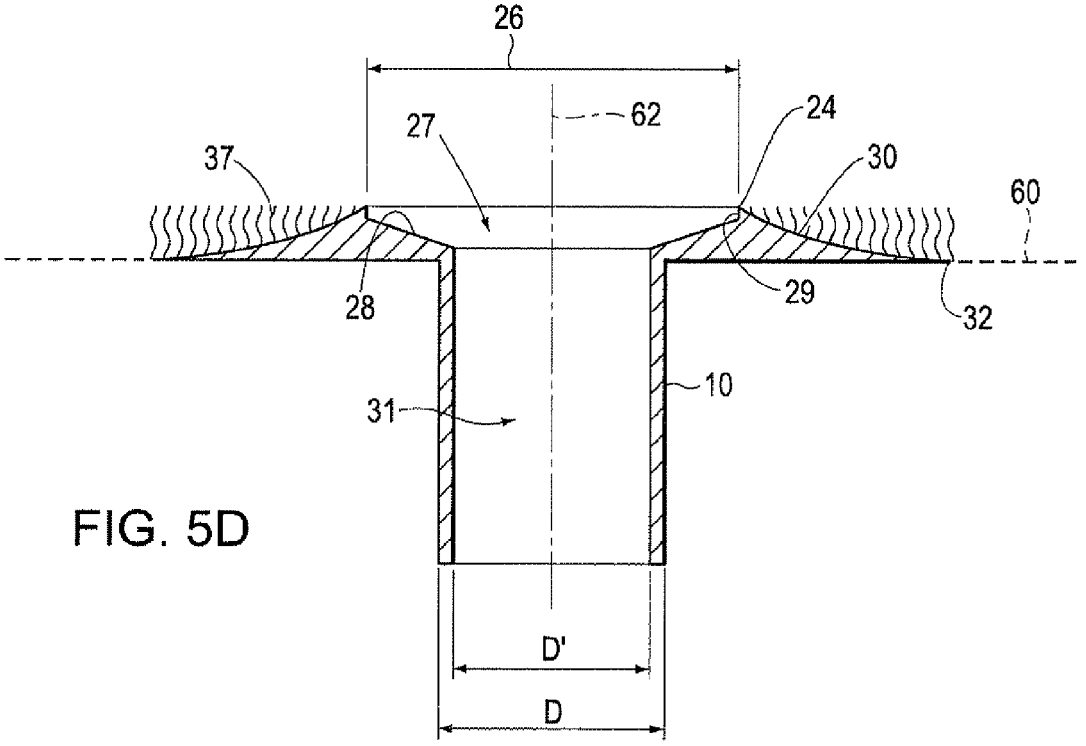
FIG. 5D is a cross-sectional view of a fourth alternative configuration of the golf cup accessory of the first embodiment.

Alternatively, only a top portion of the adapter 10 may be hollow. As used herein, the top portion of the adapter 10 is the portion of the adapter 10 that, when the adapter 10 is inserted into a standard golf cup, includes the end of the adapter 10 that is closest to the turf. In this case, while in use, a golf ball that rolls into the trapping portion 20 may fall within the hollow portion of the adapter 10, but would not ultimately fall within the standard golf cup. When only the top portion of the adapter 10 is hollow, the trapping portion 20 may have a substantially upwardly concave shape. However, as shown in FIGS. 4-5D, in this embodiment, the trapping portion 20 need not be limited to such shape. In fact, the trapping portion 20 may have any shape that defines a hollow space that is sufficiently large to receive a golf ball. Alternatively, the adapter 10 may be a solid piece.

Figure 7:
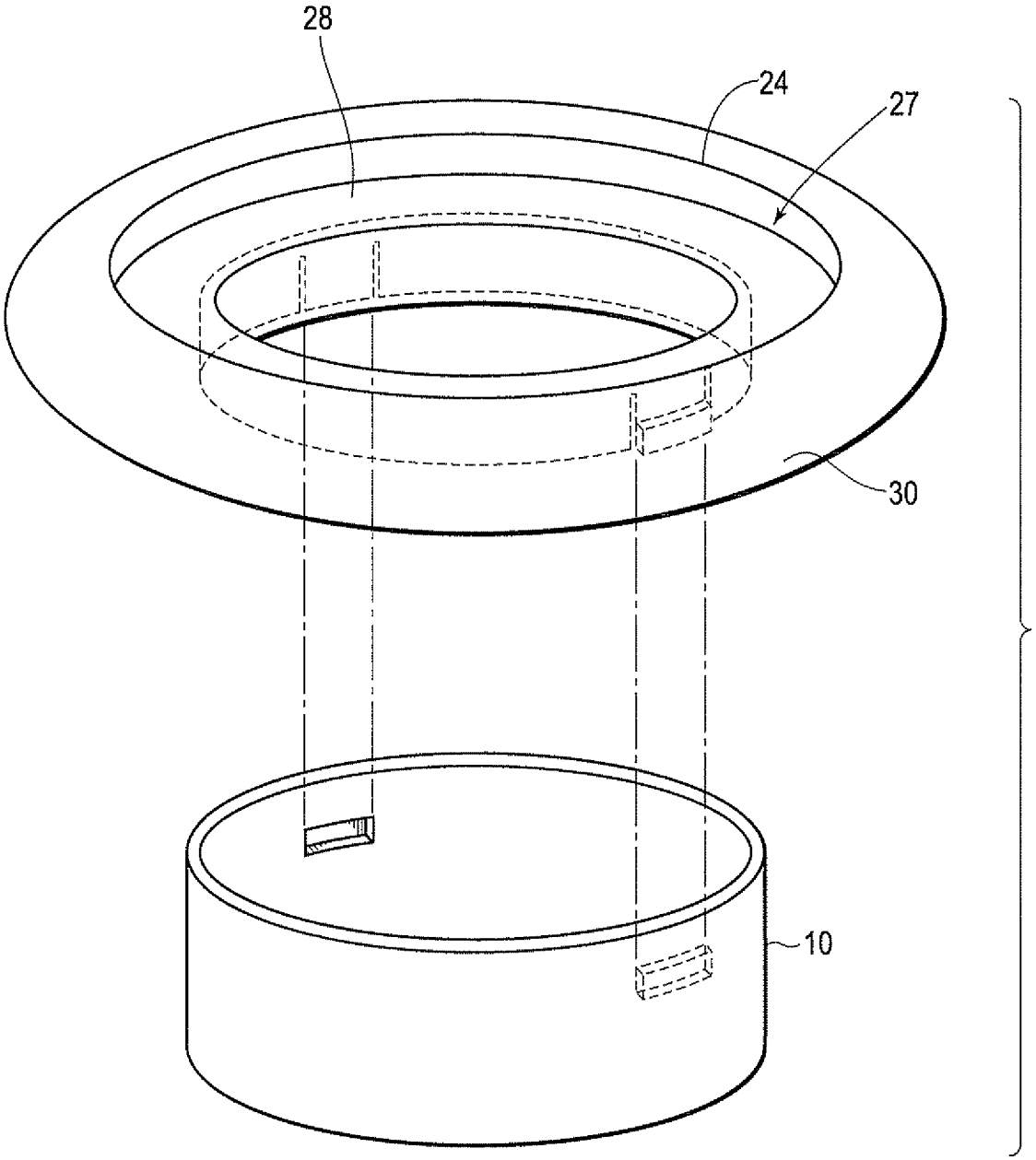
FIG. 7 is a perspective view of a detachable component according to a second embodiment of the present invention.

The trapping portion 20 of the golf cup accessory 1 is coupled to the adapter 10. The coupling means between the adapter 10 and the trapping portion 20 may vary. For instance, as shown in FIG. 1, the adapter 10 and the trapping portion 20 may be formed of a substantially unitary body. Alternatively, as shown in FIG. 7, in the second embodiment (discussed below), the trapping portion 20 may be detachably connected to the adapter 10.

As shown in FIGS. 4-5D, the trapping portion 20 includes a bottom surface 28, and an upper edge 24 that delimits a generally planar approach area 26. As used herein, the approach area 26 of the golf cup accessory 1 is the area of the portion of an imaginary plane defined by the upper edge 24 of the trapping portion 20, such that when the golf cup accessory 1 is installed in a standard golf cup, a golf ball that is located in the approach area 26 will become trapped by trapping portion 20 (see e.g. FIGS. 3 and 4). When the golf cup accessory 1 is installed in a standard golf cup, the approach area 26 is substantially parallel to a standard golf cup approach area. As used herein, the standard golf cup approach area is the area of the portion of an imaginary plane defined by a top edge of the opening of a standard golf cup. The opening of a standard golf cup has a substantially circular shape, with a diameter of the top edge being about 4.25 inches (within a reasonable margin of error) and a radius of about 2.125 inches. Accordingly, the standard golf cup approach area is substantially equal to the area of a circle (i.e., $\pi r^2$) with a radius of 2.125 inches, or approximately 14.2 $in^2$.

The approach area 26 is greater than the standard golf cup approach area, and the size of the approach area 26 may vary depending on how much easier it is desired to make putting. Therefore, the approach area 26 is greater than approximately 14.2 $in^2$. In some embodiments, the approach area 26 is substantially larger than the standard golf cup approach area. For example, in one embodiment, the approach area 26 is at least twice the size of the standard golf cup approach area. However, the approach area 26 need not be limited to such ratio, as long as the approach area 26 is greater than the standard golf cup approach area.

Figure 3:
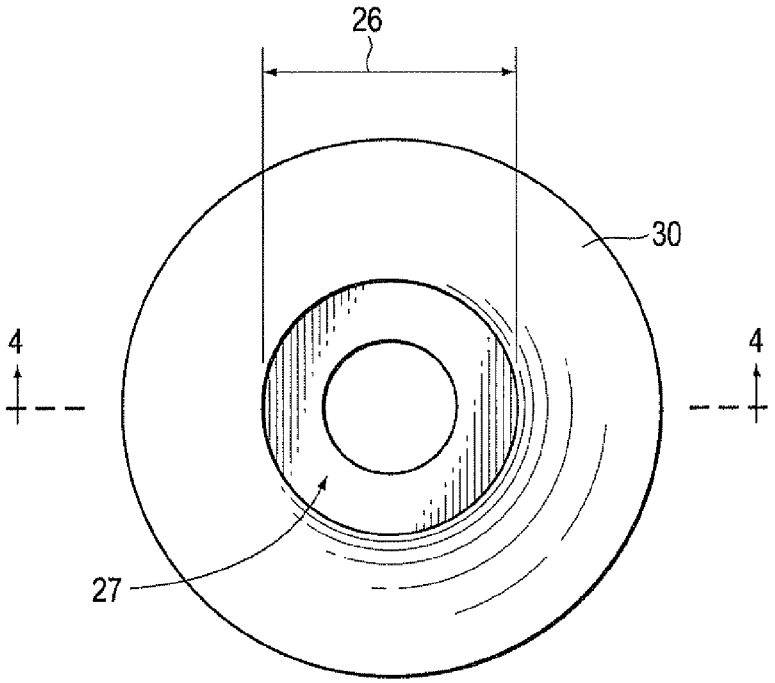
FIG. 3 is a plan view of the golf cup accessory of FIG. 1.

The shape of the approach area 26 may vary. For instance, as shown in FIG. 3, the approach area 26 of the trapping portion 20 may have a substantially circular shape, with an inner diameter that is greater than 4.25 inches. For example, the inner diameter of the approach area 26 may range between about 4.25 inches and about 25 inches. More preferably, the diameter of the approach area 26 may range between about 4.5 inches and about 17 inches. Even more preferably, the diameter of the approach area 26 may range between about 6 inches and about 15 inches. Most preferably, the diameter of the approach area 26 may range between about 8 inches and about 15 inches.

However, the approach area 26 need not be limited to a substantially circular shape. Rather, the approach area 26 may have any desired polygonal shape, or any other shape, so long as the area of an imaginary plane defined by the upper edge 24 of the trapping portion 20 is greater than the standard golf cup approach area (i.e., greater than about 14.2 $in^2$).

The trapping portion 20 includes a recess 27 for receiving a golf ball. A number of exemplary alternative configurations of the trapping portion 20 are shown in FIGS. 4-5D. As shown in FIGS. 4-5D, when the golf cup accessory 1 is installed in a standard golf cup extending downward from a generally planar turf surface 60, the bottom surface 28 may be substantially parallel to the turf surface 60. Further, as shown in FIGS. 4-5D, the length U of the bottom surface 28, is optionally less than the radius of a golf ball, thereby preventing a golf ball from coming to rest on the bottom surface 28. Alternatively, as shown in FIGS. 5C and 5D, at least a portion of the bottom surface 28 may taper downwardly in a direction toward a central axis 62 of the standard golf cup. However, the bottom surface 28 need not be limited to such configuration. For instance, in some embodiments the bottom surface 28 follows a generally linear inclined path. In other embodiments, the bottom surface 28 follows an upwardly concave path or, alternatively, an upwardly convex path, when the golf cup accessory 1 is in an operating orientation/position. Preferably, the bottom surface 28 of the trapping portion 20 tapers downwardly toward the central axis 62 of the golf cup over the entirety of the bottom surface 28, e.g. in a funnel-like or conical manner.

Further, as shown in FIGS. 4-5D, a vertical sidewall 29 extends substantially vertically from the bottom surface 28 of the recess 27 in an upward direction, when the golf cup accessory 1 is in an operating orientation/position. The vertical sidewall 29 at least partially surrounds the bottom surface 28 of the recess 27.

The rise 30 of the golf cup accessory 1 is adjacent to the trapping portion 20 and serves as a ramp, guiding a golf ball toward the upper edge 24 of the trapping portion 20. Referring to FIGS. 4-5D, the rise 30 may have various configurations. For example, as shown in FIG. 4, when the golf cup accessory 1 is in an operating orientation/position, the rise 30 may have an upwardly concave inclined upper surface. Alternatively, as shown in FIG. 5A, when the golf cup accessory 1 is in an operating orientation/position, the rise 30 may have a substantially flat inclined upper surface. Further, as shown in FIG. 5B, when the golf cup accessory 1 is in an operating orientation/position, the rise 30 may have an upwardly convex inclined upper surface. However, the rise 30 need not be limited to the above-discussed configurations, and may in fact have any configuration or combinations of multiple configurations, as long as when the golf cup accessory 1 is in an operating orientation/position, the rise 30 guides a golf ball from a lower end 32 thereof (i.e., closest to the turf) to the upper edge 24 of the trapping portion 20.

As shown in FIG. 5A, the rise 30 has an angle of inclination θ. As used herein, the angle of inclination θ is the angle formed between the planar turf surface 60 and the inclined surface of the rise 30, measured in an imaginary vertical plane (e.g. in the plane of the paper as shown in FIG. 5A) that passes through the central axis 62 of the golf cup, when the golf cup accessory 1 is in an operating orientation/position. The angle of inclination θ may be selected from a range of values having a lower limit and an upper limit. Preferably, the inclination angle θ is selected based on at least the following considerations: (1) the degree to which the presence of the golf cup accessory 1 affects golf ball trajectory as compared with a conventional turf surface with a standard golf cup; and (2) the degree to which the presence of the golf cup accessory 1 affects the trapping (or failing to trap) of a rolling golf ball as compared with a conventional turf surface with a standard golf cup. The lower limit is preferably sufficient to prevent a golf ball from rolling out, where the golf ball would not have rolled out from a standard golf cup, thus minimizing consideration (2). The upper limit is preferably a value that avoids significant disruption of ball travel path (as compared with the anticipated ball travel path for the same trajectory on a planar standard green surface), thus minimizing consideration (1). In view of the above considerations, the angle of inclination θ of the rise 30 may, for example, be less than or equal to about 30 degrees, is more preferably less than or equal to about 20 degrees, and is even more preferably less than or equal to about 10 degrees. Thus, the angle of inclination θ of the rise 30 may range between about 2 degrees and about 10 degrees, more preferably between about 4 degrees and about 10 degrees. In some embodiments (e.g. where the inclined surface of the rise 30 is non-linear), the inclination angle θ varies along the inclined surface. In such embodiments, the maximum inclination angle θ is preferably within the ranges discussed above with regard to the linear inclined surface as shown in FIG. 5A.

As shown in FIG. 5A, the rise 30 has a height H. As used herein, the height H of the rise 30 is the vertical distance between the lower end 32 and the upper edge 24 of the trapping portion 20, when the golf cup accessory 1 is in an operating orientation/position. The height H is preferably selected based on similar considerations as those relating to the inclination angle θ discussed above. Specifically, the height H may range between about 0.125 inches and about 6 inches. More preferably, the rise 30 may have a height H that ranges between about 0.125 inches and about 4 inches. Most preferably, the rise 30 may have a height H that ranges between about 0.125 inches and about 2 inches. For example, the height H may have a value of about 0.25 inches, of about 0.50 inches, of about 0.75 inches, or any other value within the above ranges.

As shown in FIG. 5A, the upper surface of the rise 30 has a length L. As used herein, the length L of the inclined surface of the rise 30 is the shortest distance between a point positioned on the lower end 32 of the inclined surface of the rise 30 (i.e., closest to the turf) and the upper edge 24 of the trapping portion 20, when the golf cup accessory 1 is in an operating orientation/position. That is, the length L of the upper surface of the rise 30 is the shortest distance that a golf ball will travel along the rise 30, from the lower end 32 of the inclined surface of the rise 30 to arrive at the recess 27 of the trapping portion 20. The length L is preferably selected based on similar considerations as those relating to the inclination angle θ discussed above. Thus, the length L of the rise 30 may, for example, be less than or equal to about 8 inches, and preferably less than or equal to about 5 inches. Alternatively, the length L of the rise 30 may range between about 0.5 inch and about 5 inches. Most preferably, the length L of the rise 30 may range between about 1 inch and about 4 inches.

As shown in FIG. 5B, the rise 30 may include a weight element 36 that helps retain the rise 30 as close to the ground as possible. The weight element 36 may be an integral part of the rise 30, or a separate element. For example, the weight element 36 may be a high-density insert that is attached to the bottom of the rise 30. In such embodiment, the weight element 36 preferably comprises a specific gravity greater than the specific gravity of the rise portion. More preferably, the weight insert comprises a specific gravity greater than 5 and, even more preferably, a specific gravity greater than 7. The high-density insert may have a ring-like shape, or any desired shape. Further, the weight element 36 may be attachable to the rise 30 by various means. For example, the weight element 36 may be mechanically attached by fasteners that snap the weight element 36 into place, or attached using adhesives or welding. Alternatively, the weight element 36 may be a thickened portion that is made of the same material as the rise 30, but with higher density, or may comprise a different, higher-density material that is co-molded with the rise 30. In some embodiments, a weight member is alternatively or additionally secured to other portions of the golf cup accessory 1, e.g. to the adapter 10 or to the trapping portion 20.

The upper surface of the rise 30 may include a surface treatment. For instance, as shown in FIG. 5D, the upper surface of the rise 30 may include a turf-like material 37. The turf-like material 37 may help conceal the inclination of the rise 30, thereby allowing the golf cup accessory 1 to blend-in with the natural turf. Further, the turf-like material 37 may vary in height. For instance, as shown in FIG. 3F, the turf-like material 37 may decrease in height from the lower end 32 of the rise 30 to the upper edge 24. In addition to concealing the inclination of the rise 30, the turf-like material 37 also aids the golf ball in transitioning from turf to the various surfaces of the golf cup accessory 1, further minimizing deviation in ball trajectory, as compared with ball trajectory in a standard environment, i.e. a conventional golf cup extending downward from a conventional putting turf.

The bottom surface 28 of the recess 27 may include various golf ball trajectory modifiers disposed thereupon. For example, an ultra-smooth surface treatment, or a material of high rolling resistance may be applied to at least part of the bottom surface 28. As used herein, an ultra-smooth surface is a surface having a surface roughness ($R_a$) no greater than about 10 μin. However, more preferably, in embodiments including an ultra-smooth surface, at least a portion of the bottom surface 28 of the trapping portion comprises a surface roughness ($R_a$) no greater than 5 μin. The benefit of such a surface is to minimize friction between the surface and a golf ball to such an extent as to prevent, or substantially minimize, the ability of the golf ball to roll, thus expediting travel of the golf ball toward the central axis 60. This minimizes the ability of the golf ball to escape from the trapping portion 20. As used herein, a material of high rolling resistance is a material having a rolling resistance (or rolling friction) coefficient that is approximately equal to or larger than that of conventional billiard felt, relative to a conventional ionomer-coated golf ball. The material of high rolling resistance may include, for example, foam, a gel-like material, a sand-like material, a visco-elastic material, a polymeric material, a rubber, a fabric, or a felt. A surface having a high rolling resistance reduces the kinetic energy of the golf ball, thus decreasing the ability of the golf ball to escape from the trapping portion.

Further, baffles may be included on at least part of the bottom surface 28. The baffles may reduce the speed of a golf ball and/or advantageously modify the golf ball's trajectory, e.g. direct the golf ball toward the central axis 62. The baffles may include, for example, auxiliary recesses, projections, a combination of auxiliary recesses and projections, and/or one or more ribs. For instance, the ribs 23 discussed below constitute projections, while the regions between the ribs 23 define auxiliary recesses. Alternative configurations of projections and recesses are possible, including projections not formed as ribs and auxiliary recesses formed as indentations or concavities in the bottom surface 28 itself.

Figure 6A:
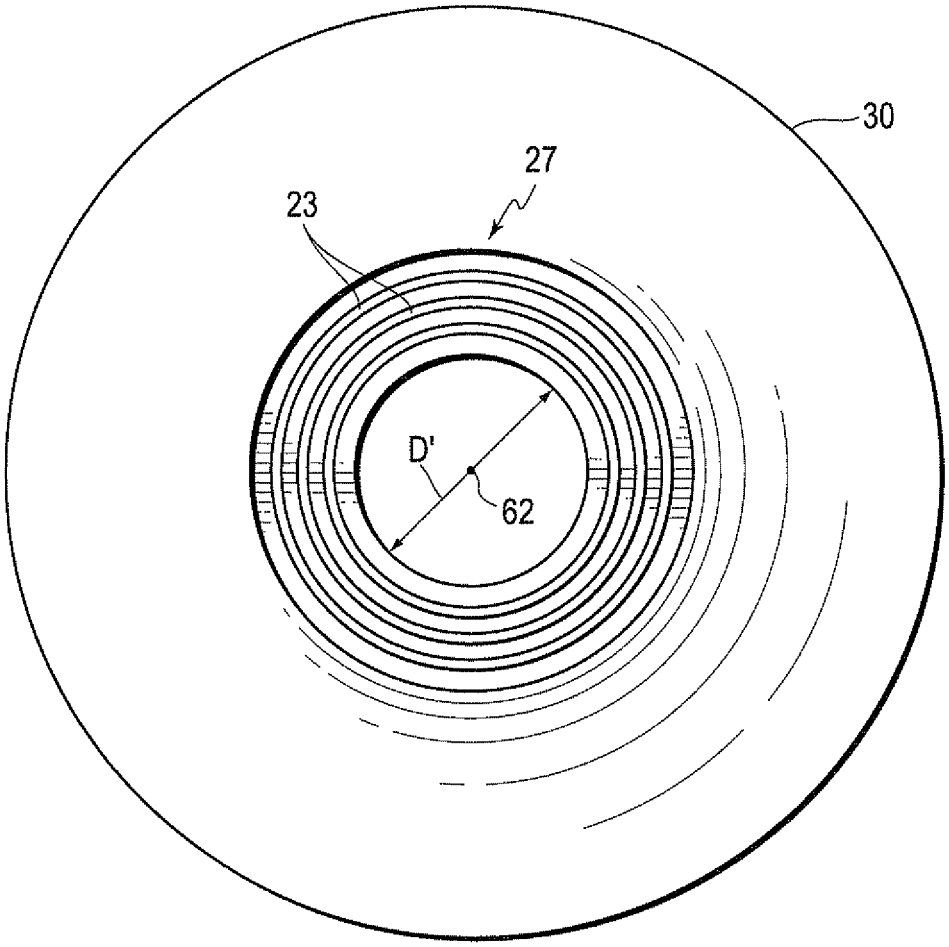
FIGS. 6A-E are plan views of additional alternative configurations of the golf cup accessory of the first embodiment.
Figure 6B:
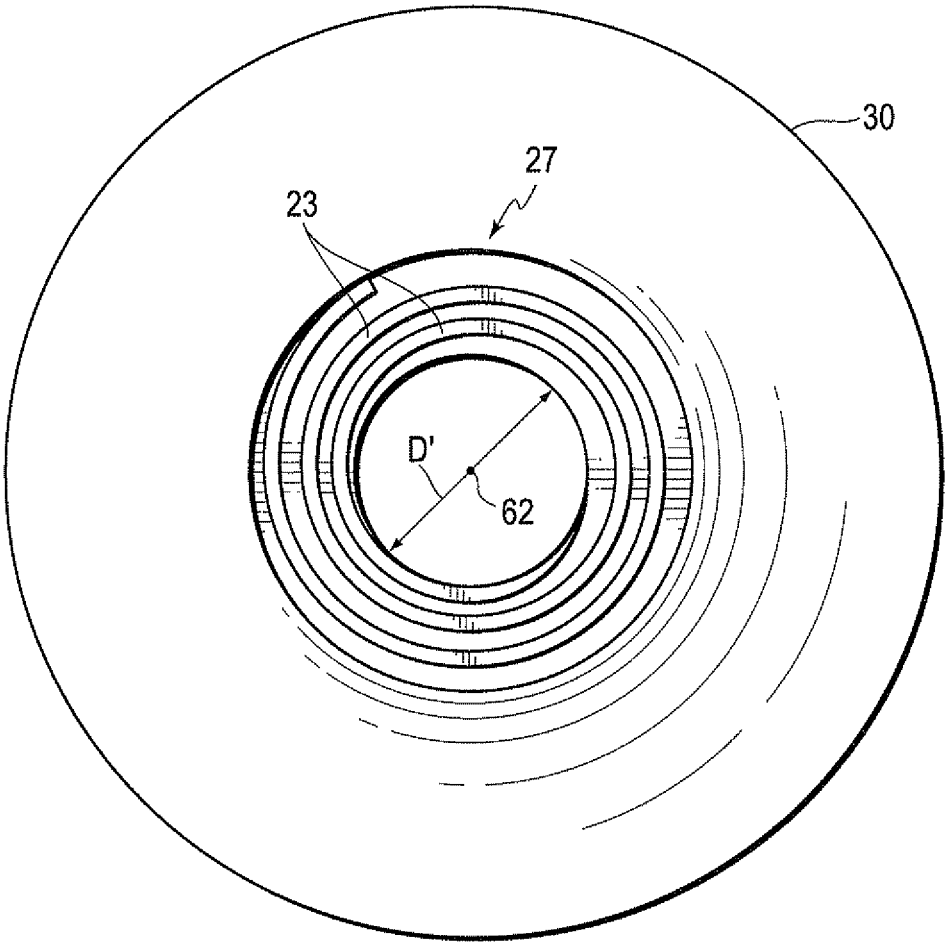
Figure 6C:
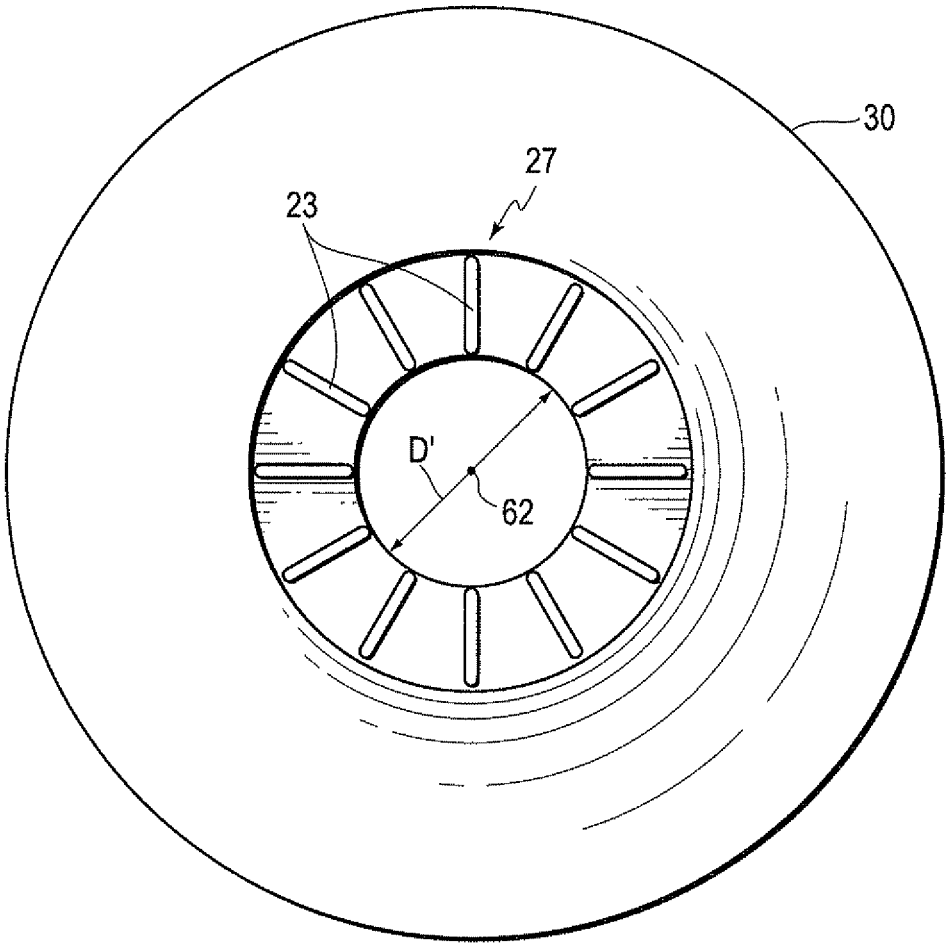
Figure 6D:
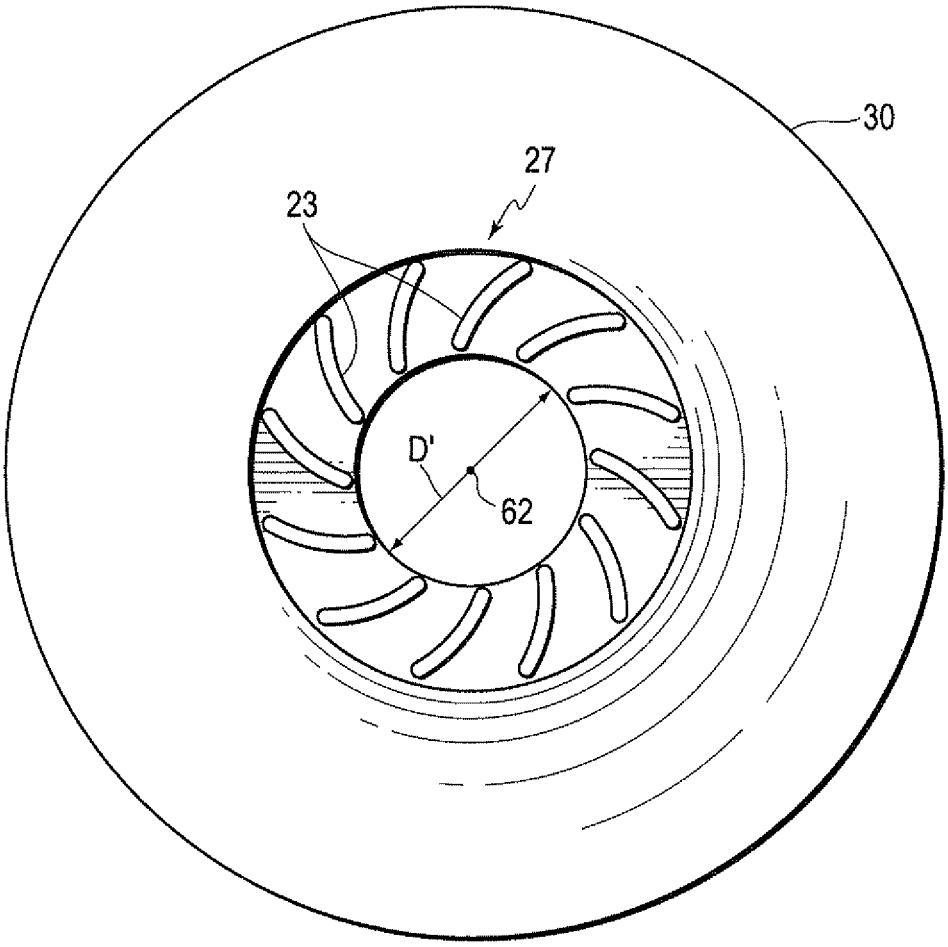
Figure 6E:
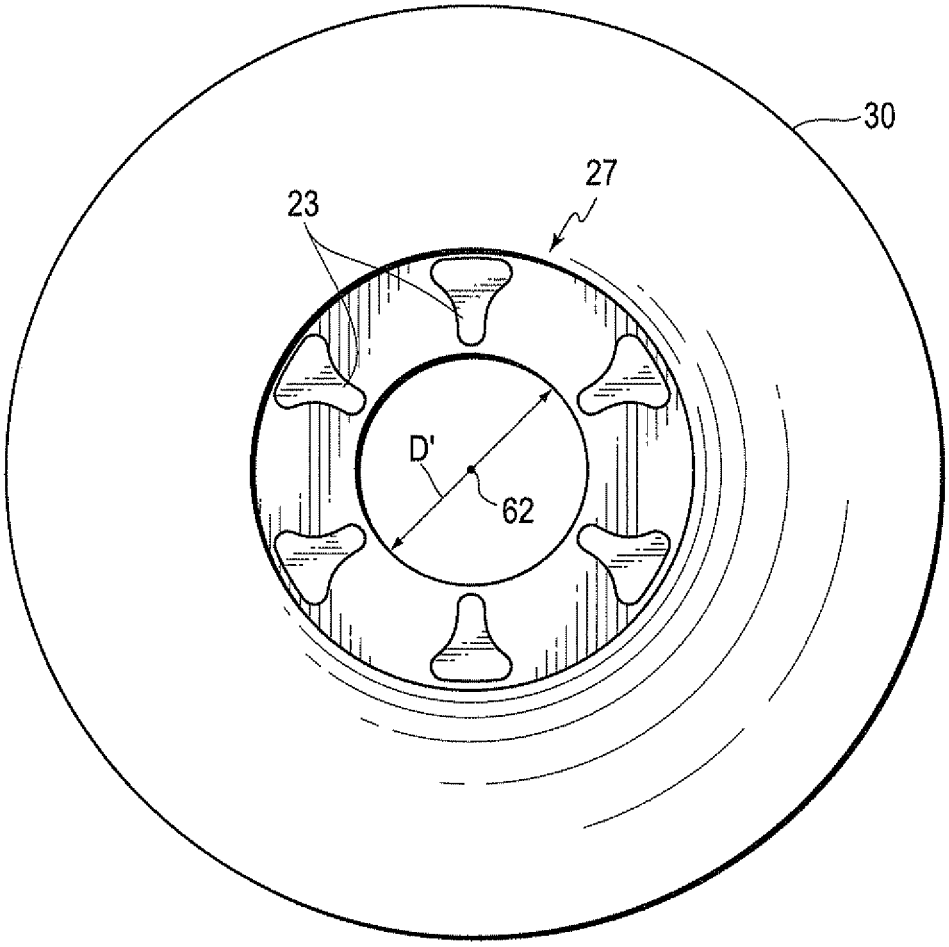

As shown in FIGS. 6A-6E, the ribs 23 may be aligned in various configurations. For example, as shown in FIG. 6A, the ribs 23 may be substantially concentrically aligned relative to a central axis 62 of the golf cup accessory 1, when the golf cup accessory 1 is in an operating orientation/position. As shown in FIG. 6B, the ribs 23 may be substantially spiral-like. As shown in FIG. 6C the ribs 23 may be substantially radially aligned relative to the central axis 62 of the golf cup accessory 1. Alternatively, as shown in FIG. 6D, the ribs 23 may have a generally arcuate shape and optionally follow a helical path as shown. Moreover, as shown in FIG. 6E, the ribs 23 may be arranged to define portions of the bottom surface 28 that are formed between the ribs 23. Such portions may have any desired shape, as may occur to those of ordinary skill in the art, as long as portions of the bottom surface 28 are formed by the ribs 23.

As evidenced by the foregoing description, the golf cup accessory 1 according to the first embodiment increases the effective approach area from the approach area of the standard golf cup (i.e., approximately 14.2 $in^2$) to the much larger approach area 26 of the golf cup accessory 1. The much larger approach area 26 of the golf cup accessory 1 makes putting easier and thereby prevents some of the frustration that new golfers may face as they learn to putt.

According to the first embodiment, the adapter 10 is configured to easily fit within a standard golf cup. Thus, installation of the golf cup accessory 1 requires no specialized tools, requires no specialized training and thus may be carried out quickly, even by the most inexperienced golfer. Further, when necessary, removal of the golf cup accessory 1 is just as easy as installation.

According to the first embodiment, the trapping portion 20 not only effectively increases the approach area of a standard golf cup, but may also be configured to alter the trajectory of a golf ball, thus increasing the likelihood that a golf ball will become trapped by the trapping portion 20 and thereby avoiding the potential disappointment of the ball escaping the trapping portion 20.

Also, according to the first embodiment, the rise 30 may be configured to blend in with the natural surroundings. Thus, the golf cup accessory 1 can increase the likelihood of a successful putt without calling attention to its user. Additionally, in some embodiments, additional mechanical attachment members are incorporated in the structure of the accessory 1 for removably attaching the accessory to a portion of a conventional golf bag or a portion of a golf cart. For example, a magnetic element may be associated with the accessory such that the accessory may be removably securable to metallic portions of a golf cart.

Figure 8A:
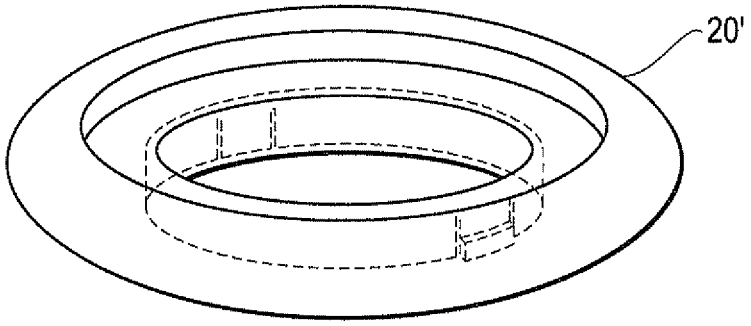
FIGS. 8A and 8B are perspective views of detachable components according to the second embodiment of the present invention.
Figure 8B:
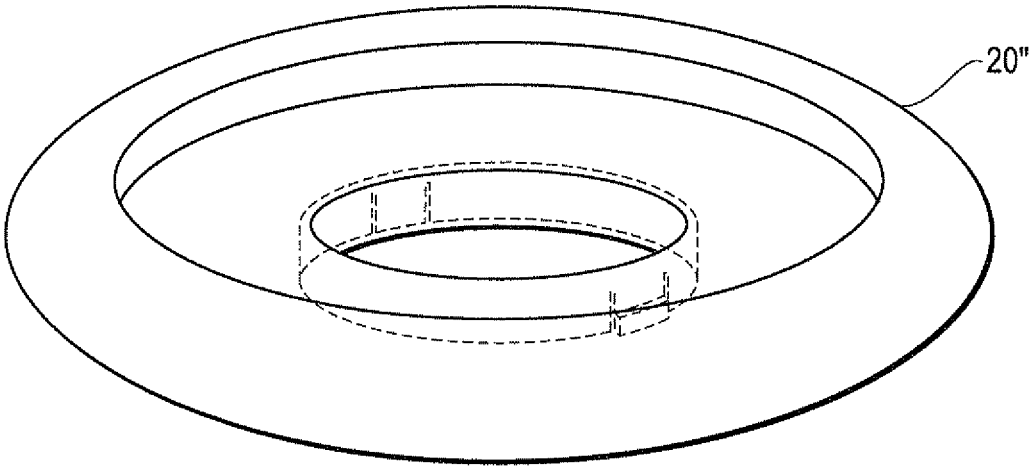

As shown in FIG. 7, according to a second embodiment, a detachable coupling between the trapping portion 20 and the adapter 10 may, for example, allow the adapter 10 to remain within the standard golf cup upon removal of the trapping portion 20. Further, as shown in FIGS. 8A and 8B, the detachable trapping portion 20 may have different size configurations 20' and 20".

Thus, the golf cup accessory 1 according to the second embodiment reduces the cargo space required for its storage in, for example, a golf bag. Moreover, the golf cup accessory 1 according to the second embodiment may be easily customized to meet the individual needs of any given golfer. For instance, the golf cup accessory 1 according to the second embodiment may allow a group of golfers with varying degrees of skill to golf together, as the trapping portion 20 may be easily detached from the adapter 10, so that the more skilled players in a group may putt into a standard golf cup approach area, while the trapping portion 20 may be attached to the adapter 10, so that the younger or less skilled golfers in the group may putt into the much larger approach area of the golf cup accessory 1 according to the second embodiment of the present invention.

Figure 9:
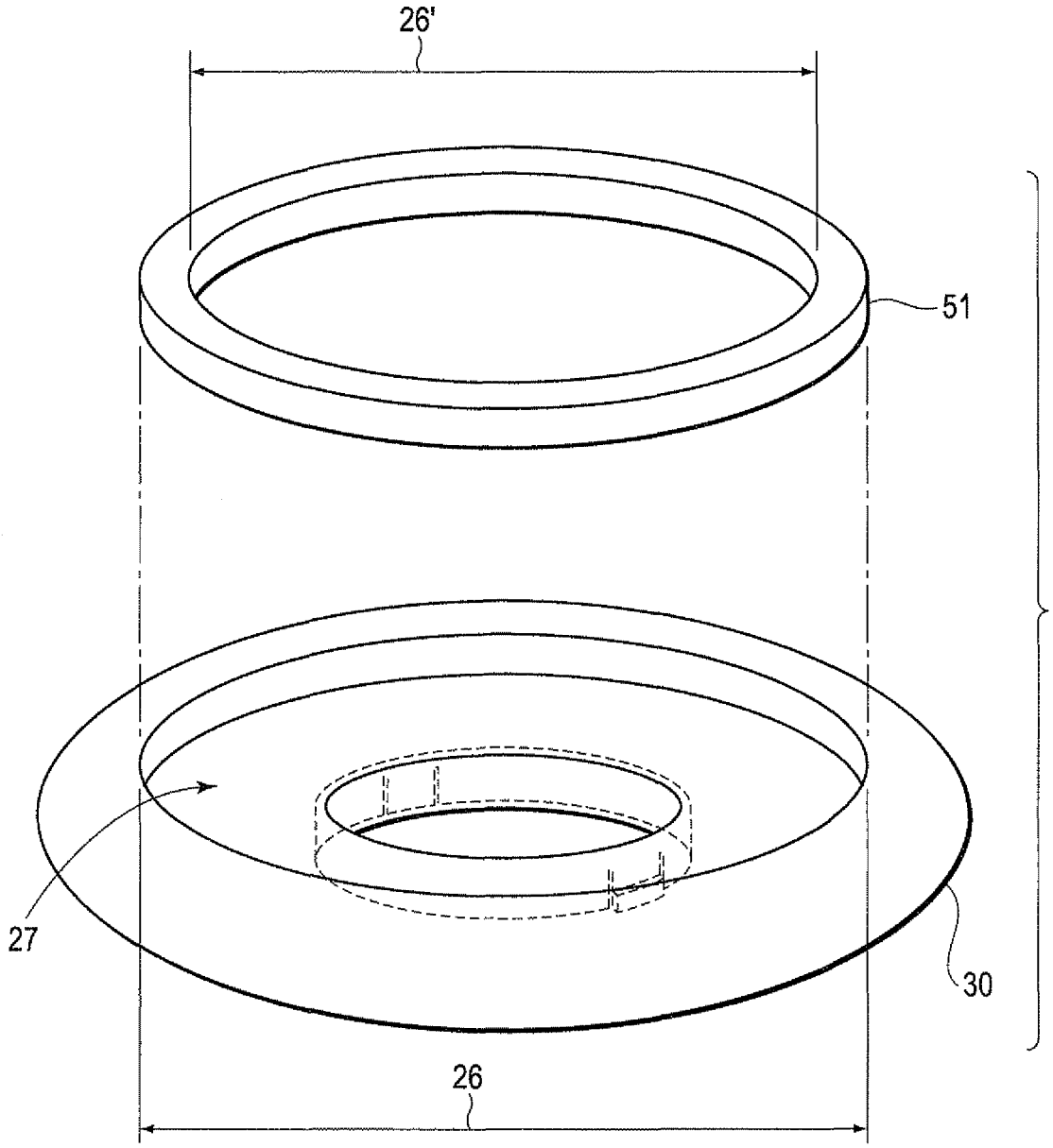
FIG. 9 is a perspective view of a customizable detachable component.

Further, as shown in FIG. 9, the recess 27 may include an insert 51, which reconfigures the golf cup accessory 1 to have a planar approach area 26', which is different in size from planar approach area 26. Thus, the golf cup accessory 1 may be customized to meet the individual requirements and skill level of any given golfer. The insert 51 is usable with any of the embodiments described herein.

Figure 10:
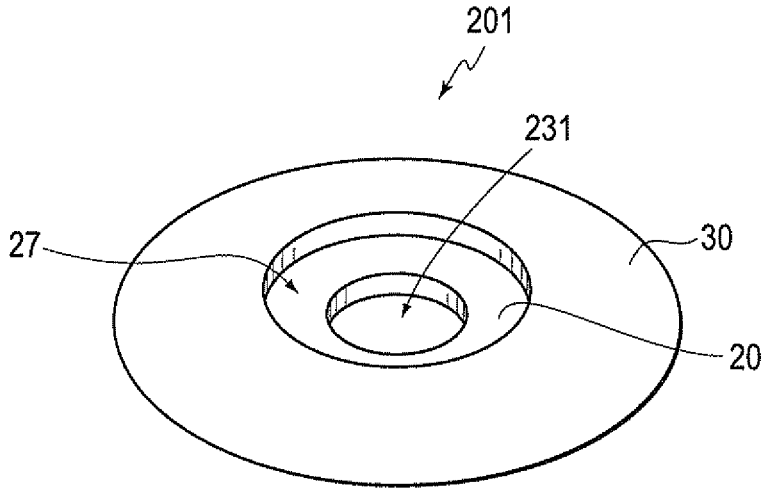
FIG. 10 is a perspective view of a golf cup accessory according to a third embodiment of the present invention.
Figure 11:
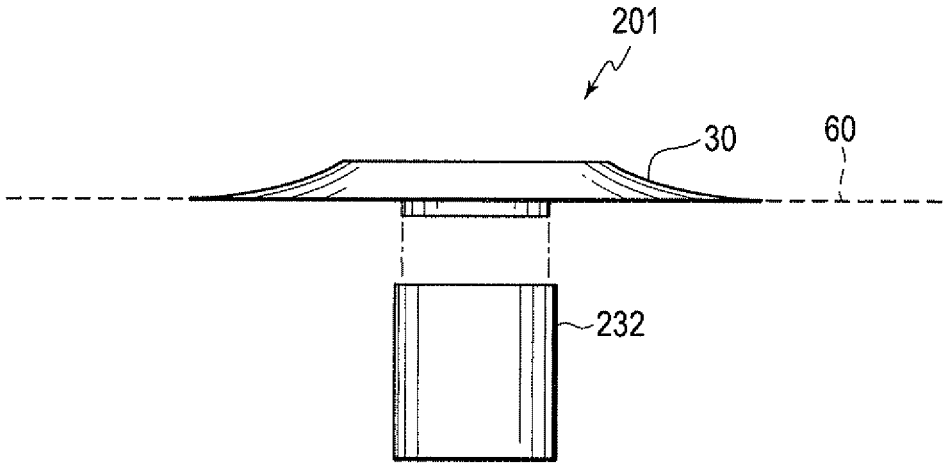
FIG. 11 is a side view of the golf cup accessory of FIG. 10.

Referring to FIGS. 10 and 11, a third exemplary embodiment of a golf cup accessory 201 for association with a standard golf cup is depicted. Like the previous embodiments, the golf cup accessory 201 includes a rise 30 and a trapping portion 20 that is coupled to the rise 30. Further, the trapping portion 20 includes a recess 27 and delimits a generally planar approach area that is greater in size than an approach area of the standard golf cup. Further, one or more of the above-described golf ball trajectory modifiers of the previous embodiments can be applied to this embodiment. However, as shown in FIGS. 10 and 11, the golf cup accessory 201 according to the third embodiment of the present invention includes a much shorter throughbore 231 that is aligned with an opening formed by the standard golf cup 232. Alternatively, no throughbore can be used.

As evidenced by the foregoing description, the golf cup accessory 201 according to the third embodiment increases the effective approach area from the approach area of the standard golf cup to the much larger approach area of the golf cup accessory 201. Therefore, the golf cup accessory 201 according to the third embodiment makes putting easier and thereby prevents some of the frustration that new golfers may face as they learn to putt. However, in addition to the benefits of the previous embodiments, because of the shorter length of the throughbore 231, the accessory 201 is more easily transportable in, for example, a golf bag.

Figure 12:
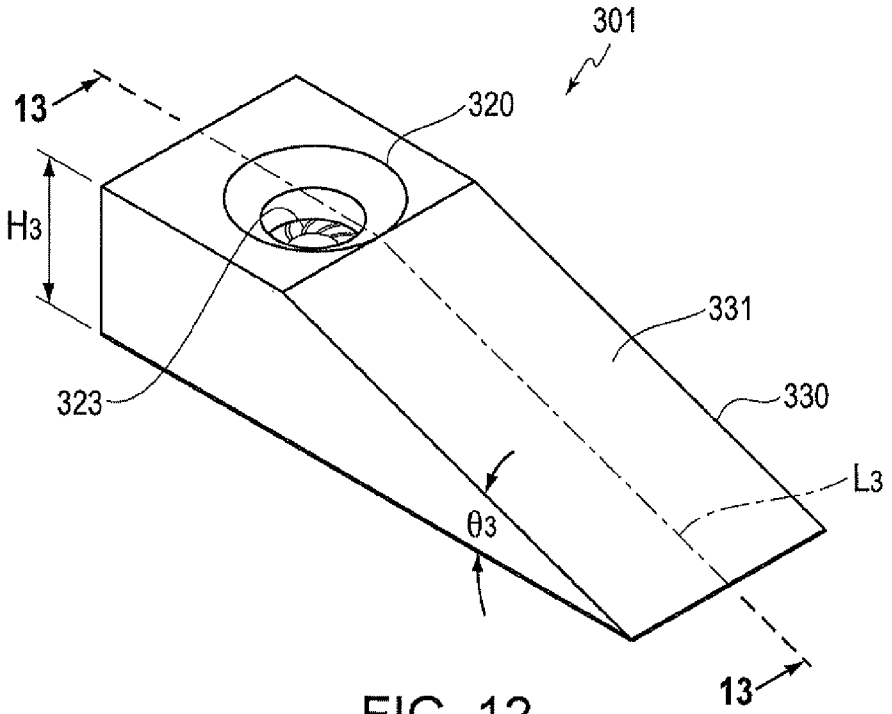
FIG. 12 is perspective view of a practice golf cup according to a fourth embodiment of the present invention.
Figure 13:
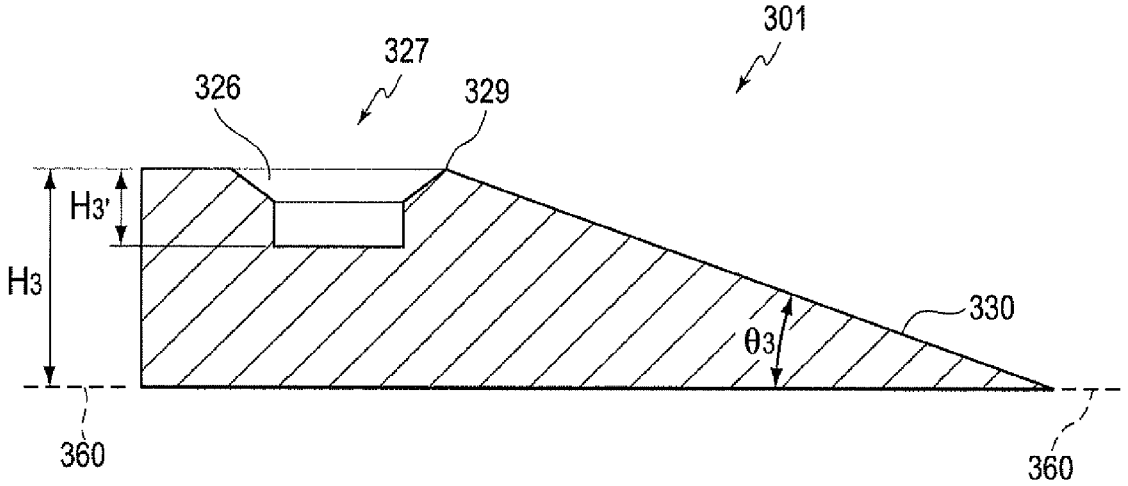
FIG. 13 is a cross-sectional view of the practice golf cup of FIG. 12 along line 13-13.

A practice golf cup according to a fourth embodiment of the present invention will now be described with reference to FIGS. 12 and 13. The practice golf cup 301 includes a rise portion 330 and a trapping portion 320 coupled to the rise portion 330. The rise portion 330 differs from the previously disclosed embodiments in that the rise portion 330 according to the fourth embodiment is defined by a portable structure that allows the practice golf cup 301 to be carried to, and disposed on, any surface. For instance, as shown in FIG. 12, the rise portion 330 may be a portable ramp that defines a path along which a golf ball travels.

The rise portion 330 may have multiple configurations. For instance, as shown in FIG. 12, the rise portion 330 may have a substantially elongated portion, substantially corresponding to the shape of a rectangle, when the practice golf cup 301 is viewed from above, while the practice golf cup 301 is in an operating orientation/position. However, the rise portion 330 need not be limited to such configuration and may in fact have any desired shape, including a substantially circular shape, substantially oval shape, or any other desired polygonal shape as may occur to those of ordinary skill in the art.

The plane defined by the rise portion 330 may have any desired angle of inclination $\theta_3$ with respect to a planar surface 360 upon which the practice golf cup 301 rests when the practice golf cup 301 is in an operating orientation/position. Thus, the angle of inclination $\theta_3$ may vary according to the skill level of a given golfer, and may be selected based on similar considerations as those relating to the inclination angle $\theta$ in the previously disclosed embodiments, as long as the angle of inclination $\theta_3$ defines a height $H_3$ (a highest region) of the practice golf cup 301 that is equal to or greater than a height $H_3$, of the trapping portion 320, when the practice golf cup 301 is in the operating orientation/position.

The upper surface 331 of the rise portion 330, when the practice golf cup 301 is in an operating orientation/position, may have multiple configurations. For instance, as shown in the embodiment of FIG. 13, the upper surface 331 may be substantially linear. Alternatively, as with the other disclosed embodiments, the upper surface 331 may include one or more non-linear regions, as may occur to those of ordinary skill in the art, depending on the skill level of a golfer. Further, as with the other disclosed embodiments the upper surface 331 may include a turf-like material.

The location of the trapping portion 320 of the practice golf cup 301 may vary. For instance, as shown in FIGS. 12 and 13, the trapping portion 320 may be positioned proximate the highest region $H_3$ of the practice golf cup 301. Alternatively, the trapping portion 320 may be positioned closer to a lowermost end of the rise portion 330. Further, the trapping portion 320 may be positioned substantially along an imaginary centerline $L_3$ running along a longitudinal axis of the rise portion 330. Alternatively, the trapping portion 320 may be positioned off-center, and thus virtually anywhere along the rise portion 330 as may occur to those of ordinary skill in the art, depending on the level of skill of a given golfer.

The trapping portion 320 includes a recess 327, a rim 329, and a surface portion 328 that includes a golf ball trajectory modifier. As in the previously disclosed embodiments, the golf ball trajectory modifier may include an ultra-smooth surface, a material of high rolling resistance, or at least one baffle. The material of high rolling resistance may include a foam, a gel-like material, a sand-like material, a visco-elastic material, a polymeric material, a rubber, a fabric, or a felt.

The baffle may comprise one or more ribs 323. Further, like in the previously disclosed embodiments, the configuration of the ribs 323 may vary. Thus, as shown in FIGS. 6A-6E, when the practice golf cup 301 is in an operating orientation/position, the ribs 323 may be substantially concentrically aligned, substantially radially aligned, or substantially spiral-like. Moreover, the ribs 323 may have a generally arcuate shape and optionally follow a helical path. Additionally, the ribs 323 may be arranged to define portions of the surface 328 that are enclosed within boundaries formed by the ribs 323.

The approach area 326 of the trapping portion 320 may vary. For instance, in one embodiment the approach area 326 of the trapping portion 320 may be two times greater than the approach area of a standard golf cup. In other embodiments, the approach area 326 may be even greater. In fact, the approach area 326 may be any size, as long as the approach area 326 of the trapping portion 320 is greater than the approach area of a standard golf cup.

As evidenced by the foregoing description, the practice golf cup 301 according to the fourth embodiment increases the effective approach area from the approach area of the standard golf cup to the much larger approach area 326 of the practice golf cup 301, thereby making putting easier and thus preventing some of the frustration that new golfers may face as they learn to putt.

Further, the practice golf cup 301 of the fourth embodiment is portable, and thus requires no installation, other than simply disposing the practice golf cup 301 on a given surface. This portability allows the practice golf cup 301 to be used in virtually any setting. Thus, a user may be able to, for example, bring the practice golf cup 301 to work and use it as time permits, thereby maximizing practice time. Further, due to its portability, the practice golf cup 301 of the fourth embodiment may be easily stowed away when not in use. Further, the trapping portion 320 not only effectively increases the approach area of a standard golf cup, but may also be configured to alter the trajectory of a golf ball. Thus, the practice golf cup 301 not only reduces the potential disappointment of a missed shot, but also reduces likelihood of damage caused by a stray golf ball when the practice golf cup 301 is used in a confined and crowded space.

Those skilled in the art will appreciate that while the present invention has been described in association with presently preferred aspects thereof, numerous changes, modifications, and substitutions of equivalents may be made therein without departing from the spirit and scope of this invention, which is not intended to be limited by the foregoing description, except as may appear in the following appended claims.

What is claimed is:

1. An accessory for association with a standard golf cup, the golf cup accessory comprising:

an adapter configured to securely fix in place the accessory by engaging with a wall of the standard golf cup;

a trapping portion coupled to the adapter, the trapping portion having a recess and delimiting a generally planar approach area that is greater in size than an approach area of the standard golf cup; and a rise coupled to the trapping portion.

2. The golf cup accessory according to claim 1, wherein, when the accessory is in an operating position, the trapping portion further comprises a downwardly extending throughbore extending from the bottom surface of the trapping portion entirely through the accessory.

3. The golf cup accessory according to claim 1, wherein the recess comprises a bottom surface, and wherein, when the accessory is in an operating position, at least a portion of the bottom surface tapers downwardly toward a central axis of the golf cup.

4. The golf cup accessory according to claim 3, wherein the recess further includes a substantially vertical side wall at least partially surrounding the bottom surface of the recess.

5. The golf cup accessory according to claim 1, wherein, when the accessory is in an operating position, the rise comprises an upwardly concave inclined upper surface.

6. The golf cup accessory according to claim 1, wherein, when the accessory is in an operating orientation, the rise comprises an inclined upper surface having a maximum height between about 0.125 inches and about 2 inches.

7. The golf cup accessory according to claim 6, wherein the upper surface of the rise further comprises a slope between about 2 degrees and about 10 degrees.

8. The golf cup accessory according to claim 6, wherein a length of the upper surface of the rise is equal to or less than 5 inches.

9. The golf cup accessory according to claim 1, further comprising at least one weight element.

10. The golf cup accessory according to claim 9, wherein the rise is formed of a first material and the weight element is formed of a second material different from the first material.

11. The golf cup accessory according to claim 10, wherein the first material has a first density and the second material has a second density that is greater than the first density.

12. The golf cup accessory according to claim 3, wherein the bottom surface of the recess of the trapping portion includes a golf ball trajectory modifier selected from the group consisting of an ultra-smooth surface, a material of high rolling resistance, and at least one baffle.

13. The golf cup accessory according to claim 12, wherein the trajectory modifier comprises a material of high rolling resistance selected from the group consisting of a foam, a gel-like material, a sand-like material, a visco-elastic material, a polymeric material, a rubber, a fabric, and a felt.

14. The golf cup accessory according to claim 12, wherein the trajectory modifier comprises baffles selected from the group consisting of auxiliary recesses, projections, and a combination of auxiliary recesses and projections.

15. The golf cup accessory according to claim 12, wherein the trajectory modifier comprises at least one baffle comprising one or more ribs.

16. The golf cup accessory according to claim 15, wherein the ribs are substantially radially aligned relative to a central axis of the golf cup, when the accessory is in an operating orientation.

17. The golf cup accessory according to claim 16, wherein each rib comprises a generally arcuate shape.

18. The golf cup accessory according to claim 1, wherein the adapter comprises a substantially cylindrical outer surface.

19. The golf cup accessory according to claim 1, wherein the accessory is reconfigurable between a first configuration, in which the trapping portion delimits a first generally planar approach area, and a second configuration, in which the trapping portion delimits a second generally planar approach area that is greater in size than the first approach area.

20. The golf cup accessory according to claim 1, wherein the trapping portion is detachably connected to the adapter.

21. The golf cup accessory of claim 1, wherein the trapping portion approach area is no less than twice the size of the standard golf cup approach area.

22. An accessory for association with a standard golf cup, the golf cup accessory comprising:

a trapping portion having a recess and delimiting a generally planar approach area that is greater in size than an approach area of the standard golf cup;

a rise coupled to the trapping portion; and an adapter coupled to the trapping portion;

wherein, when the accessory is in an operating position, the accessory includes a downwardly extending throughbore that aligns with an opening formed by the standard golf cup and extends entirely through the trapping portion, the downwardly extending throughbore being sized to permit passage of a conventional golf ball therethrough, and the adapter being configured to have a snug fit within the standard golf cup.

23. The golf cup accessory according to claim 22, wherein the recess comprises a bottom surface configured such that, when the accessory is in an operating position, at least a portion of the bottom surface tapers downwardly toward a central axis of the golf cup.

24. The golf cup accessory according to claim 23, wherein the recess further includes a substantially vertical side wall at least partially surrounding the bottom surface of the recess.

25. The golf cup accessory according to claim 22, further comprising at least one weight element, wherein the rise is formed of a first material and the weight element is formed of a second material different from the first material.

26. The golf cup accessory according to claim 23, wherein the bottom surface of the recess of the trapping portion includes a golf ball trajectory modifier selected from the group consisting of an ultra-smooth surface, a material of high rolling resistance, and at least one baffle.

27. The golf cup accessory according to claim 26, wherein the trajectory modifier comprises a material of high rolling resistance selected from the group consisting of a roughened material, a foam, a gel-like material, a sand-like material, a visco-elastic material, a polymeric material, a rubber, a fabric, and a felt.

28. The golf cup accessory according to claim 26, wherein the trajectory modifier comprises baffles selected from the group consisting of auxiliary recesses, projections, and a combination of auxiliary recesses and projections.

29. The golf cup accessory according to claim 26, wherein the trajectory modifier comprises at least one baffle comprising one or more ribs.

30. The golf cup accessory according to claim 29, wherein the ribs are substantially radially aligned relative to a central axis of the golf cup, when the accessory is in the operating position.

31. The golf cup accessory according to claim 30, wherein each rib comprises a generally arcuate shape.

32. The golf cup accessory according to claim 22, wherein the accessory is reconfigurable between a first configuration, in which the trapping portion delimits a first generally planar approach area, and a second configuration, in which the trapping portion delimits a second generally planar approach area that is greater in size than the first approach area.

33. The golf cup accessory of claim 22, wherein the trapping portion approach area is no less than twice the size of the standard golf cup approach area.

* * * * *